US005083345A

United States Patent [19]

Leifeld

[11] Patent Number: 5,083,345

[45] Date of Patent: Jan. 28, 1992

[54] APPARATUS FOR FEEDING FIBER TUFTS TO A FIBER PROCESSING MACHINE

[75] Inventor: Ferdinand Leifeld, Kempen, Fed. Rep. of Germany

[73] Assignee: Trützschler GmbH & Co. KG, Mönchengladbach, Fed. Rep. of Germany

[21] Appl. No.: 570,542

[22] Filed: Aug. 21, 1990

[30] Foreign Application Priority Data

Aug. 26, 1989 [DE] Fed. Rep. of Germany ..... 3928280

[51] Int. Cl.[5] ..... D01G 23/04; D01G 15/40

[52] U.S. Cl. ..... 19/105; 19/296

[58] Field of Search ..... 19/65 R, 65 A, 97, 105, 19/240, 296, 300, 304

[56] References Cited

U.S. PATENT DOCUMENTS

| | | | |
|---|---|---|---|
| 3,443,372 | 5/1969 | Eddleston | 19/105 X |
| 3,521,998 | 7/1970 | Grüner et al. | 19/105 |
| 3,737,265 | 6/1973 | Schafer et al. | 19/300 X |
| 4,090,521 | 5/1978 | Elsner | 19/105 X |
| 4,176,988 | 12/1979 | Lattmann et al. | 19/105 X |
| 4,364,153 | 12/1982 | Beneke et al. | 19/107 |
| 4,712,277 | 12/1987 | Gustavsson | 19/304 X |
| 4,811,463 | 3/1989 | Leifeld | 19/105 |
| 4,928,355 | 5/1990 | Leifeld | 19/105 |
| 4,970,759 | 11/1990 | Roberson | 19/105 |

FOREIGN PATENT DOCUMENTS

| | | | |
|---|---|---|---|
| 113819 | 7/1984 | European Pat. Off. . | |
| 2137139 | 2/1972 | Fed. Rep. of Germany . | |
| 2548320 | 7/1976 | Fed. Rep. of Germany | 19/105 |
| 2587041 | 3/1987 | France . | |
| 4533857 | 12/1967 | Japan | 19/105 |
| 4113571 | 4/1968 | Japan | 19/105 |
| 0647368 | 2/1979 | U.S.S.R. | 19/296 |
| 1509433 | 9/1989 | U.S.S.R. | 19/105 |
| 1284214 | 8/1972 | United Kingdom . | |
| 1339802 | 12/1973 | United Kingdom . | |
| 2019914 | 11/1979 | United Kingdom . | |

*Primary Examiner*—Werner H. Schroeder
*Assistant Examiner*—Ismael Izaguirre
*Attorney, Agent, or Firm*—Spencer & Frank

[57] ABSTRACT

An apparatus for feeding fiber tufts to a fiber processing machine, including a fiber reserve device; an intake device drawing fiber tufts from the fiber reserve device; a fiber opening device adjoining the intake device and being arranged for receiving fiber tufts from the intake device; and a substantially horizontally oriented feed chute having an inlet connected to the outlet of the fiber reserve device. The fiber opening device advances fiber tufts into the inlet of the feed chute. The apparatus further includes a blower for introducing an air stream into the feed chute through the inlet thereof. The feed chute has an outlet for discharging fiber tufts therefrom and air outlet openings in the outlet zone for discharging air from the feed chute.

16 Claims, 4 Drawing Sheets

1a
A
1c
B
9
1b
C
1b
B
1
H
9a
1d
2a
3
2
F
G
5
4
4a
6
8
3a
8'
D
4c
E
4b
5
7
F
4d
BLOWER

APPARATUS FOR FEEDING FIBER TUFTS TO A FIBER PROCESSING MACHINE

CROSS REFERENCE TO RELATED APPLICATION

This application claims the priority of Federal Republic of Germany Application No. P 39 28 280.5, filed Aug. 26th, 1989, which is incorporated herein by reference.

BACKGROUND OF THE INVENTION

This invention relates to an apparatus for feeding fiber material (such as cotton, chemical fibers or the like) in fiber tuft form to a fiber processing machine such as a card, a roller card unit, a cleaner or the like. The apparatus has a reserve device from which the fiber material is taken by a device formed, for example, of a slowly rotating intake roll and a stationary counterface cooperating therewith. With the intake roll there is associated an opening device, such as a rapidly rotating opening roll which receives the fiber material from the intake roll. From the opening device the fiber material is admitted to a feed chute through a charging opening into which an air stream is forced which leaves the feed chute through air exit openings provided adjacent the discharge outlet of the feed chute.

In a known apparatus of the above-outlined type the fiber reserve device is formed of a vertically oriented reserve chute followed by a feed chute. The latter, which too, is vertically oriented, has at its lower ends two delivery rolls. From the delivery rolls the fiber material is admitted indirectly—by means of a guide plate—to a feeding device, such as a feed roll and a feed table cooperating therewith, to the inlet of the fiber processing machine, such as a card. By virtue of the serial connection and superposition of the two chutes—and also because of the limited vertical space of the blow room—the fill capacity of the reserve chute is limited. It is a further disadvantage of the known apparatus that the densified fiber material situated in the feed chute cannot be directly introduced into the lower zone of the fiber processing machine, such as a card.

SUMMARY OF THE INVENTION

It is an object of the invention to provide an improved apparatus of the above-outlined type in which the capacity of the reserve chute is increased and further which makes possible the feed of the densified fiber material directly into the lower zone of the fiber processing machine, such as a card.

This object and others to become apparent as the specification progresses, are accomplished by the invention, according to which, briefly stated, the feed chute adjoining the reserve chute in the downstream direction, as viewed in the direction of the fiber feed, is substantially horizontally oriented.

By arranging the feed chute in a substantially horizontal orientation, the upstream-located reserve chute may extend significantly lower than in prior art constructions and thus the fill capacity thereof can be increased. At the same time, the horizontal arrangement of the feed chute has the additional advantage that the outlet end of the feed chute may terminate immediately in the lower zone of the fiber processing machine, for example, at the carding cylinder of a carding machine, whereby the carding area for the fiber material is increased and furthermore the increased area may be utilized to dispose therein additional carding elements, such as mote knives or stationary flats. It is a further advantage of the horizontal arrangement of the feed chute that in contrast to known arrangements a separate guiding (transfer) plate is no longer needed; this results in a structural simplification. Further, the fiber material densified in the feed chute can be immediately and directly introduced into the feeding device for the card before it is able to expand resiliently upwardly.

DESCRIPTION OF THE PREFERRED EMBODIMENTS

Figure 1:
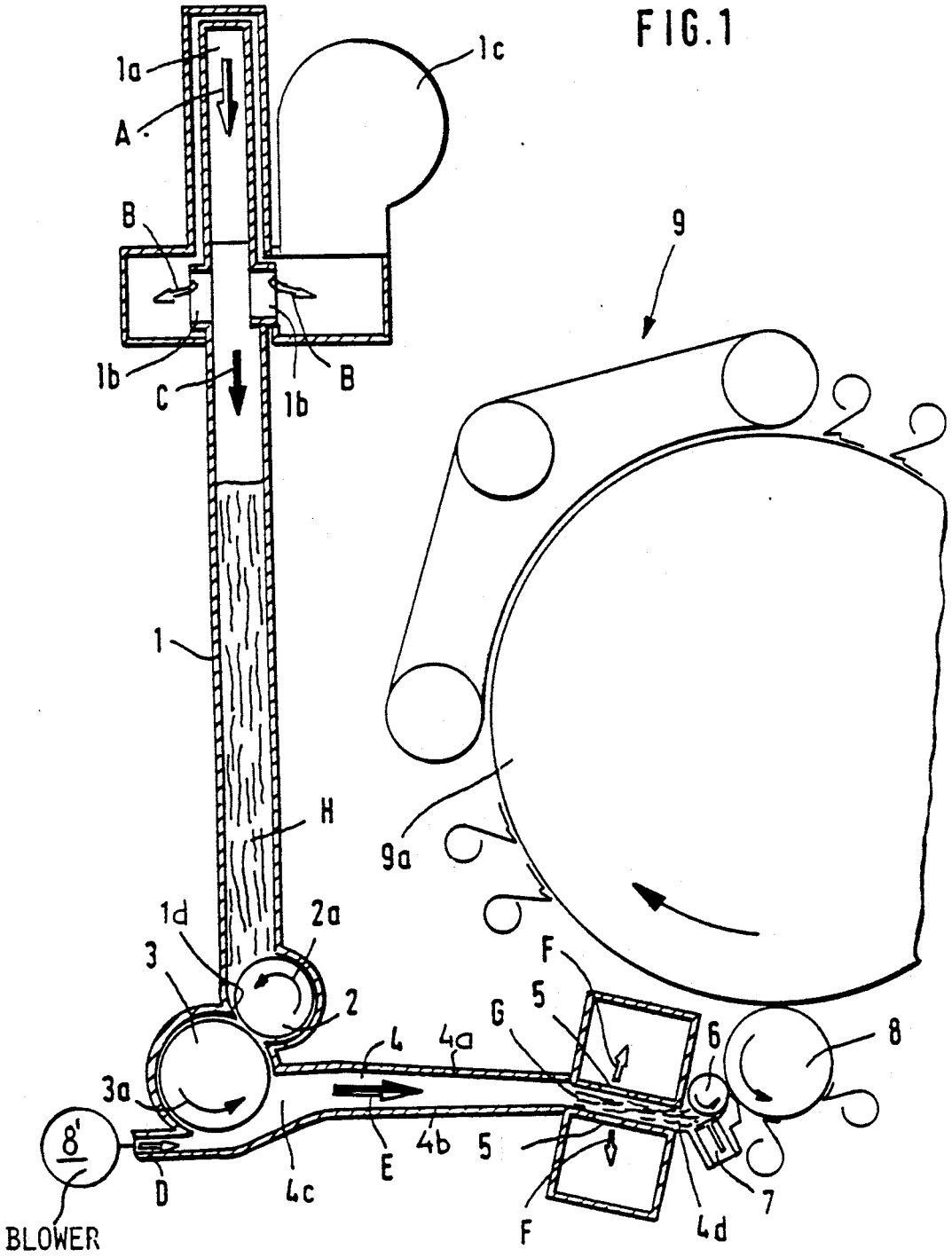
FIGS. 1 and 2 are schematic sectional side elevational views of two preferred embodiments of the invention.

Turning to FIG. 1, the construction shown therein comprises a vertically oriented fiber reserve chute 1 which is charged pneumatically with finely opened fiber material from above as indicated with the arrow A. The reserve chute 1 may receive the fiber material, for example, from a supply and distributor duct 1*a* through a non-illustrated condenser. The fiber tuft column in the reserve chute is designated at H. In the upper zone of the reserve chute 1 air outlet openings 1*b* are provided through which, upon a separation of the fiber tufts (arrow C), the conveying air exits (arrow B) and flows into a suction device 1*c*. The lower end of the reserve chute 1 is partly obturated by an intake roll 2 which rotates counterclockwise in the direction of the arrow 2*a* and which cooperates with a counterface 1*d* formed on the wall of the reserve chute 1. The intake roll 2 forwards fiber material to an opening roll (beater roll) 3 which has pins or a sawtooth wire on its surface and which partially projects into a feed chute 4. The opening roll 3 which rotates counterclockwise in the direction of the arrow 3*a* advances the fiber material to the feed chute 4 which, at its outlet end is provided with a slowly-rotated feed roll 6 cooperating with a feed table 7 to directly feed the fiber material to a licker-in 8 of a carding machine 9. Thus, the feed assembly 6, 7 functions both as a delivery device withdrawing material from the feed chute 4 and a feeding device for directly supplying the fiber processing machine, such as a card 9. The combination of the two functions in a single device results in a structural simplification.

The walls defining the feed chute 4 are, in the feed chute zone where the feed roll 6 is located, provided with air outlet openings 5 along a predetermined chute length. The pressure side of a blower 8' communicates with the inlet opening 4*c* of the feed chute 4 to generate an air stream, symbolized with the arrow D which serves for transporting the fiber tufts as indicated with the arrow E and for densifying the fiber tufts into a column G. The air stream passes tangentially by the opening roll 3 which, as indicated by the arrow 3*a*, rotates codirectionally with the direction of air flow.

The feed chute 4 is arranged in a lying (substantially horizontal) orientation, approximately at right angles to the reserve chute 1. The fiber material flows, as carried by the air stream, in the direction of the nip defined between the feed roller 6 and the feed table 7 and makes possible an automatic intake of the fiber material through the feed roll 6. In view of the flight of the fiber tuft/air stream (arrow E) and the very slight degree of fill, the walls 4*a*, 4*b* have only a very slight frictional effect on the fiber tufts. Expediently, at least one of the walls 4*a*, 4*b* is of a transparent material such as glass or Plexiglas for observing the inside of the feed chute from the exterior.

Figure 2:
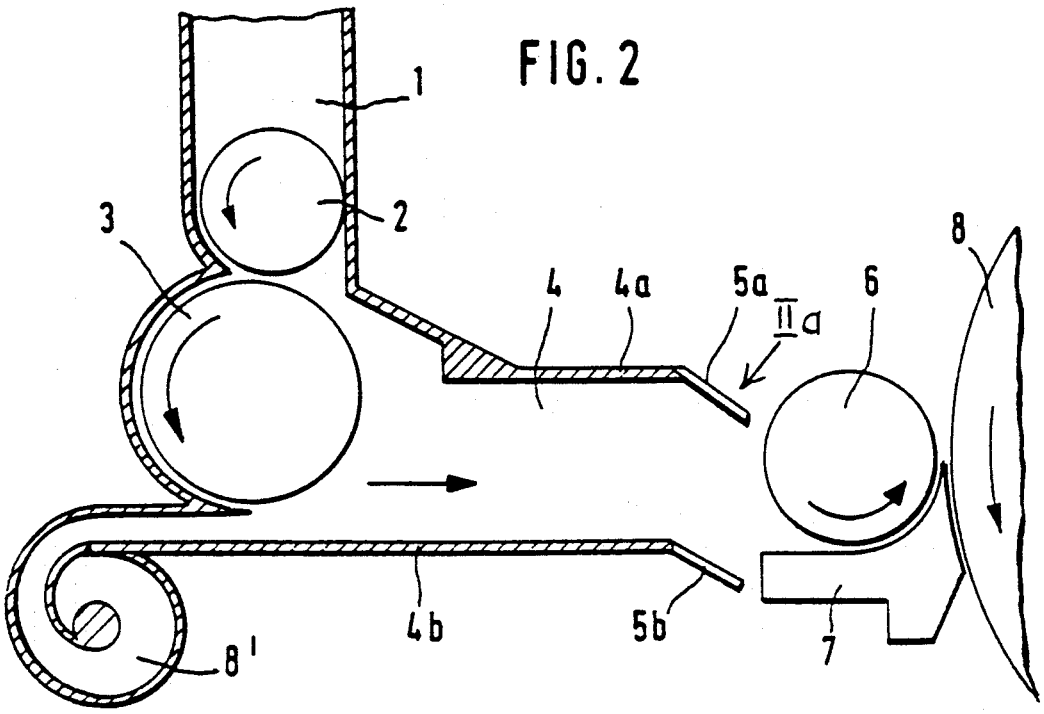
Figure 2A:
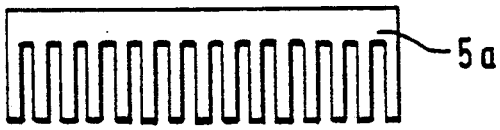
FIG. 2*a* is a view of a component of FIG. 2, as seen in the direction of the arrow 11*a*.

Turning now to the embodiment shown in FIGS. 2 and 2*a*, at the downstream (discharge) end of the horizontally oriented feed chute 4 downwardly inclined air outlet combs 5*a*, 5*b* are provided which form a constriction so that the fiber material is in a positive manner drawn into the nip defined between the feed roll 6 and the feed table 7.

Figure 3:
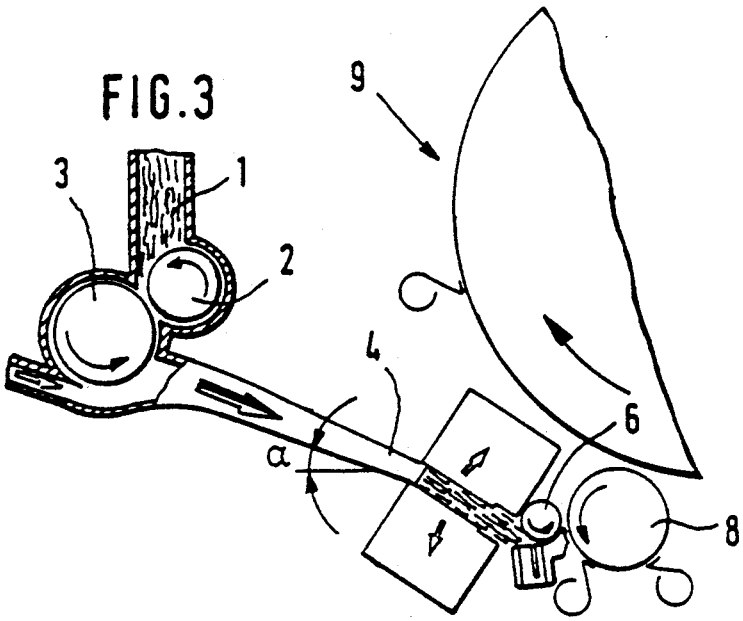
FIGS. 3, 4, 5 and 6 are schematic sectional side elevational views of four further preferred embodiments of the invention.

Turning to FIG. 3, the feed chute 4 is inclined downwardly at an angle $\alpha$ to the horizontal which may be in the range of 10°–30°. By virtue of such an arrangement, the horizontal distance between the reserve chute 1 and the carding machine 9 may be shortened.

Figure 4:
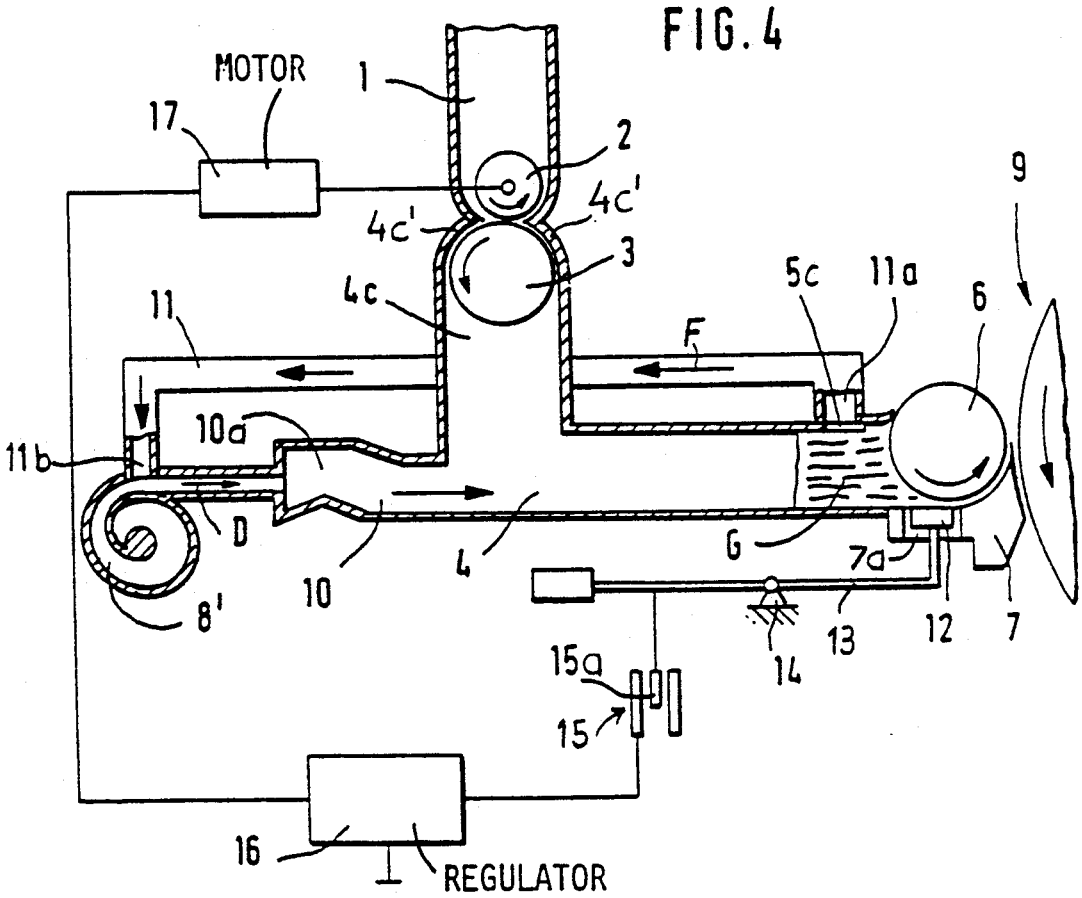

Turning to FIG. 4, underneath the opening roll 3 a short vertical feed chute portion 4*c* is provided which merges into the horizontal feed chute 4. The upper wall portions 4*c*′ of the vertical feed chute portion 4*c* follow the curvature of the intake roll 3. By virtue of the rotating intake roll 2 and the rotating opening roll 3, a certain amount of fiber material is delivered per time unit into the feed chute 4 and the same amount of fiber material is discharged by the feed roll 6 from the feed chute 4 and introduced into the carding machine 9. In order to simultaneously densify the fiber quantities and to maintain such quantities constant, the air generated by the blower 8′ impinges upon the fiber material in the feed chute 4 after the air stream has passed through a constriction 10*a* of approximately 8 mm provided in the lower side of the box-like space 10. The blower 8′ draws air through the return channel 11 and forces air through the fiber mass G in the feed chute 4. Thereafter the air which has compressed the fiber mass G exits the downstream end of the feed chute 4 through the air outlet openings 5*c* as indicated by the arrow F. The air outlet openings 5*c* are adjoined by one end 11*a* of the return channel 11, the other end 11*b* of which adjoins the suction side of the blower 8′. The feed table 7 is provided with an opening 7*a* in which a measuring element 12 is disposed for cooperating with the feed roll 6. The measuring element 12 is arranged at the end of the two-arm lever 13 which is pivotally held by a support 14. To the lever 13 the movable member 15*a* of an inductive path sensor 15 is secured which generates an electric signal as a function of the excursions of the lever 13. The inductive path sensor 15 is connected through a regulator 16 with a controllable drive motor 17 of the intake roll 2.

Figure 5:
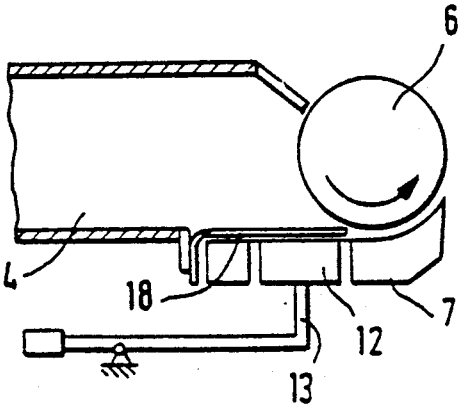

Turning to FIG. 5, above the feed table 7 and the measuring element 12 a flexible foil 18 is disposed which at one end is affixed to the feed table 7 and extends, with its other end, into the nip defined between the feed roll 6 and the feed table 7.

Figure 6:
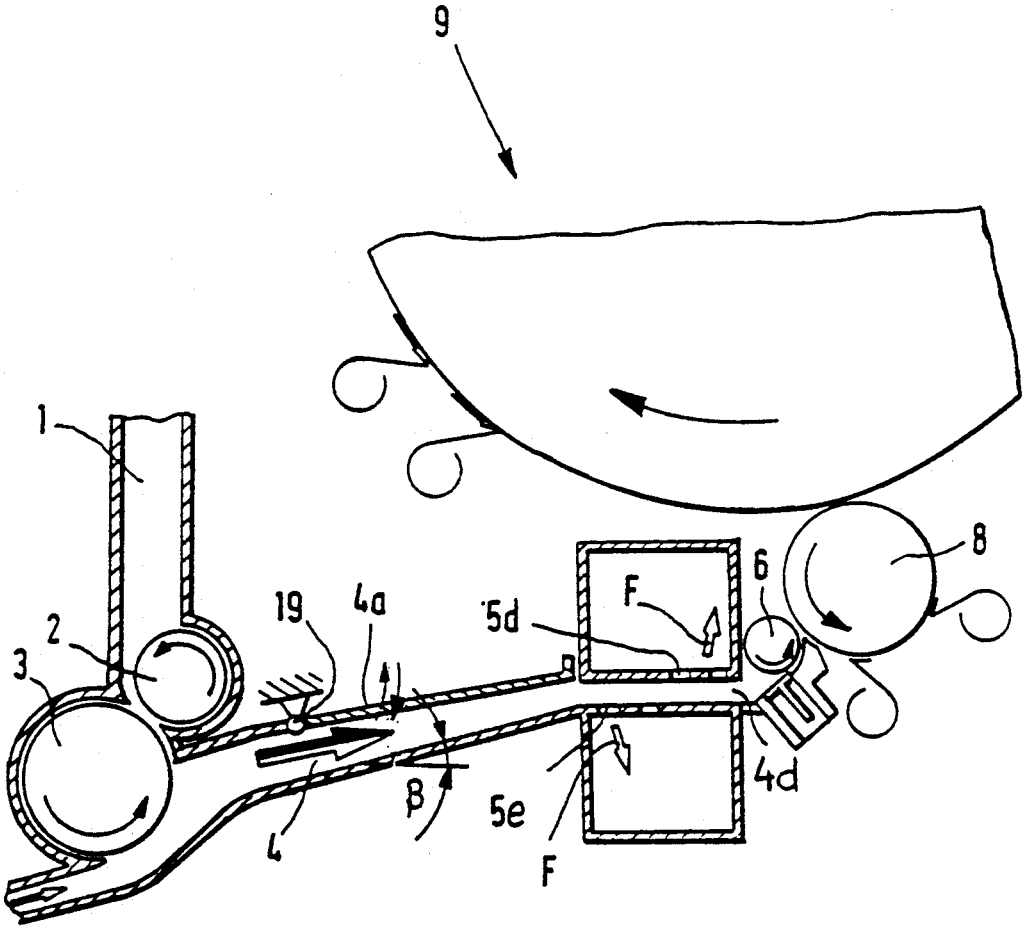

Turning to the embodiment illustrated in FIG. 6, the feed chute 4 is oriented in an upward direction at an angle of inclination $\beta$ which is approximately between 10° and 30° to the horizontal. By virtue of this arrangement, the reserve chute 1 may be further prolonged downwardly whereby an even further increase of the fill volume for the reserve chute 1 is achieved. The upper wall 4*a* of the feed chute 4 may be pivoted open about a support 19. The air outlet openings 5*d*, 5*e* are situated at different distances from the outlet opening 4*d* of the feed chute 4 such that they are arranged longitudinally offset with respect to one another.

It will be understood that the above description of the present invention is susceptible to various modifications, changes and adaptations, and the same are intended to be comprehended within the meaning and range of equivalents of the appended claims.

What is claimed is:

1. In an apparatus for feeding fiber tufts to a fiber processing machine; said apparatus including a fiber reserve device having an outlet; an intake device drawing fiber tufts from the fiber reserve device; a fiber opening device adjoining the intake device for receiving fiber tufts from the intake device; a feed chute having an inlet connected to the outlet of the fiber reserve device; said fiber opening device for advancing fiber tufts into said inlet of said feed chute; and air flow generating means for introducing an air stream into said feed chute through said inlet; said feed chute having an outlet for discharging fiber tufts therefrom and a wall portion terminating in said outlet of said feed chute; and means defining air outlet openings in a zone of said outlet of said feed chute for discharging air from said feed chute; the improvement wherein said feed chute is substantially horizontally oriented and said wall portion contains said air outlet openings.

2. An apparatus as defined in claim 1, wherein a range of the substantial horizontal orientation of said feed chute is approximately between −30° to +30° to the horizontal.

3. An apparatus as defined in claim 1, further comprising a short vertical chute portion extending from said opening device and being connected with said feed chute.

4. An apparatus as defined in claim 3, wherein said opening device is an opening roll and further wherein said short vertical chute portion includes a wall partially surrounding said opening roll and conforming in shape to a circumference thereof.

5. An apparatus as defined in claim 1, wherein said fiber opening device comprises an opening roll, further comprising means for introducing the air stream into the feed chute approximately tangentially to said opening roll, said opening roll being rotated in a direction identical to a flow direction of the air stream in a zone of the tangential introduction.

6. An apparatus as defined in claim 1, wherein said wall portion is inclined relative to a longitudinal orientation of feed chute portions preceding said wall portion.

7. An apparatus as defined in claim 6, wherein said wall portion is formed of air outlet combs.

8. An apparatus as defined in claim 1, wherein said fiber reserve device comprises a reserve chute arranged above said intake device.

9. An apparatus as defined in claim 8, wherein said reserve chute is oriented substantially vertically.

10. In an apparatus for feeding fiber tufts to a fiber processing machine; said apparatus including a fiber reserve device having an outlet; an intake device drawing fiber tufts from the fiber reserve device; a fiber opening device adjoining the intake device for receiving fiber tufts from the intake device; a feed chute having an inlet connected to the outlet of the fiber reserve device; said fiber opening device for advancing fiber tufts into said inlet of said feed chute; and air flow generating means for introducing an air stream into said feed chute through said inlet; said feed chute having an outlet for discharging fiber tufts therefrom; and means defining air outlet openings in a zone of said outlet of said feed chute for discharging air from said feed chute; the improvement wherein said feed chute is substantially horizontally oriented and further wherein said air outlet openings are provided in two opposite walls of said feed chute and the air outlet openings provided in one of said opposite walls are staggered relative to the air outlet openings in the other of said opposite walls.

11. In an apparatus for feeding fiber tufts to a fiber processing machine; said apparatus including a fiber reserve device having an outlet; an intake device drawing fiber tufts from the fiber reserve device; a fiber opening device adjoining the intake device for receiving fiber tufts from the intake device; a feed chute having an inlet connected to the outlet of the fiber reserve device; said fiber opening device for advancing fiber tufts into said inlet of said feed chute; and air flow generating means for introducing an air stream into said feed chute through said inlet; said feed chute having an outlet for discharging fiber tufts therefrom; and means defining air outlet openings in a zone of said outlet of said feed chute for discharging air from said feed chute; the improvement comprising a pivotal support; further wherein said feed chute is substantially horizontally oriented and has an upper wall portion being connected to said pivotal support and being upwardly swingable thereabout into an open position.

12. In an apparatus for feeding fiber tufts to a fiber processing machine; said apparatus including a fiber reserve device having an outlet; an intake device drawing fiber tufts from the fiber reserve device; a fiber opening device adjoining the intake device for receiving fiber tufts from the intake device; a feed chute having an inlet connected to the outlet of the fiber reserve device; said fiber opening device for advancing fiber tufts into said inlet of said feed chute; and air flow generating means for introducing an air stream into said feed chute through said inlet; said feed chute having an outlet for discharging fiber tufts therefrom; and means defining air outlet openings in a zone of said outlet of said feed chute for discharging air from said feed chute; the improvement wherein said feed chute is substantially horizontally oriented and a wall portion forming said feed chute is transparent.

13. In an apparatus for feeding fiber tufts to a fiber processing machine; said apparatus including a fiber reserve device having an outlet; an intake device drawing fiber tufts from the fiber reserve device; a fiber opening device adjoining the intake device for receiving fiber tufts from the intake device; a feed chute having an inlet connected to the outlet of the fiber reserve device; said fiber opening device for advancing fiber tufts into said inlet of said feed chute; and air flow generating means for introducing an air stream into said feed chute through said inlet; said feed chute having an outlet for discharging fiber tufts therefrom; and means defining air outlet openings in a zone of said outlet of said feed chute for discharging air from said feed chute; the improvement wherein said feed chute is substantially horizontally oriented; further comprising a feed roll arranged at said outlet of said feed chute and a feed table cooperating with the feed roll; said feed roll functioning as a delivery roll withdrawing fiber material from said feed chute; and a movably supported measuring member cooperating with said feed roll and executing excursions as a function of thickness fluctuations of the fiber material passing between the feed roll and the movable measuring member.

14. An apparatus as defined in claim 13, further comprising a drive motor connected to said intake roll; a transducer operatively coupled to the movable measuring member for converting excursions thereof into electric signals and a regulator connected to said transducer and to said drive motor for rotating the intake roll as a function of said thickness fluctuations of the fiber material.

15. An apparatus as defined in claim 13, wherein said feed table has an opening receiving said movable measuring member.

16. An apparatus as defined in claim 15, further comprising a flexible foil attached to said feed table and extending over said feed table and said movable measuring member.

* * * * *